US011602039B2

(12) United States Patent
Gamache et al.

(10) Patent No.: US 11,602,039 B2
(45) Date of Patent: Mar. 7, 2023

(54) ELECTRODE ASSEMBLIES FOR PLASMA DISCHARGE DEVICES

(71) Applicant: MÉCANIQUE ANALYTIQUE INC., Thetford Mines (CA)

(72) Inventors: Yves Gamache, Thetford Mines (CA); André Lamontagne, Thetford Mines (CA)

(73) Assignee: MÉCANIQUE ANALYTIQUE INC, Thetford Mines (CA)

( * ) Notice: Subject to any disclaimer, the term of this patent is extended or adjusted under 35 U.S.C. 154(b) by 0 days.

(21) Appl. No.: 17/414,036

(22) PCT Filed: Dec. 20, 2019

(86) PCT No.: PCT/CA2019/051888
§ 371 (c)(1),
(2) Date: Jun. 15, 2021

(87) PCT Pub. No.: WO2020/124264
PCT Pub. Date: Jun. 25, 2020

(65) Prior Publication Data

US 2022/0030693 A1 Jan. 27, 2022

Related U.S. Application Data

(60) Provisional application No. 62/782,419, filed on Dec. 20, 2018.

(51) Int. Cl.
*H05H 1/24* (2006.01)

(52) U.S. Cl.
CPC ..... *H05H 1/2418* (2021.05)

(58) Field of Classification Search
CPC ..... H05H 1/2431; H05H 1/2443; H05H 1/24; H05H 1/2418; H05H 1/2406; H05H 1/2441; H05H 1/2439; H05H 1/2437; H05J 1/025
See application file for complete search history.

(56) References Cited

U.S. PATENT DOCUMENTS 1,888,071 A 11/1932 Case
4,770,858 A 9/1988 Collins
(Continued)

FOREIGN PATENT DOCUMENTS

EP 0397468 B1 11/1990
WO WO-0074187 A1 * 12/2000 ..... C01B 13/11
(Continued)

OTHER PUBLICATIONS

International Search Report from parent PCT/CA2019/051888, dated Mar. 31, 2020. 5 Pages.
(Continued)

*Primary Examiner* — Anne M Hines
*Assistant Examiner* — Jose M Diaz
(74) *Attorney, Agent, or Firm* — FisherBroyles, LLP; Craig W. Mueller

(57) ABSTRACT

There is provided a compound electrode assembly for generating a plasma in a plasma chamber of a plasma discharge device. The compound electrode assembly includes a casing, a discharge electrode and a sealing compound. The casing is made of a dielectric material and includes at least one side wall and an end wall defining a closed end. The discharge electrode is mounted in the casing and is bonded to the end wall. The sealing compound surrounds the discharge electrode and extends within the casing.

22 Claims, 12 Drawing Sheets

(56) References Cited

U.S. PATENT DOCUMENTS

| | | | |
|---|---|---|---|
| 5,440,579 | A | 8/1995 | Molva et al. |
| 2004/0031676 | A1 | 2/2004 | Brauer et al. |
| 2009/0288773 | A1 | 11/2009 | Bolden, II et al. |

FOREIGN PATENT DOCUMENTS

| | | | |
|---|---|---|---|
| WO | 2016095035 | A1 | 6/2016 |
| WO | 2016141463 | A1 | 9/2016 |
| WO | 2017124636 | A1 | 7/2017 |

OTHER PUBLICATIONS

Written Opinion from parent PCT/CA2019/051888, dated Mar. 24, 2020. 6 Pages.
Extended European Search Report from related EP19901365.7. 8 pages. dated Aug. 23, 2022.

* cited by examiner

ELECTRODE ASSEMBLIES FOR PLASMA DISCHARGE DEVICES

TECHNICAL FIELD

The technical field generally relates to plasma discharge devices and in particular concerns a compound electrode assembly for use in such devices.

BACKGROUND

Several types of plasma discharges are known in the art. In such devices, electrodes can be used to generate a relatively stable plasma in a plasma chamber.

There remains a need in the art for electrodes that can provide improvements over available electrodes and may be of use for different applications.

SUMMARY

In accordance with one aspect, there is provided a compound electrode assembly for generating a plasma in a plasma chamber of a plasma discharge device, the compound electrode assembly comprising: a casing made of a dielectric material, the casing comprising at least one side wall and an end wall defining a closed end; a discharge electrode mounted in the casing, the discharge electrode being bonded to the end wall; and a sealing compound surrounding the discharge electrode and extending within the casing.

In some embodiments, the dielectric material is selected from the group consisting of quartz, borosilicate, ceramics and Teflon®.

In some embodiments, said at least one side wall is a tubular side wall.

In some embodiments, the end wall is a dielectric barrier of a plasma-generating mechanism of the plasma discharge device.

In some embodiments, the end wall projects within the plasma chamber.

In some embodiments, the end wall faces towards the plasma chamber.

In some embodiments, the discharge electrode is made of aluminum or platinum.

In some embodiments, the discharge electrode is bonded to the end wall with an electrically conductive adhesive or a layer of conductive compound, extending along an inside surface of the end wall.

In some embodiments, the discharge electrode comprises a disk-shaped base portion and a cylindrical-shaped lead portion.

In some embodiments, the sealing compound bonds the discharge electrode to the side wall.

In some embodiments, the sealing compound is made of a material selected from the group consisting of silicon-based potty, a ceramic with glass filler, an epoxy putty, a silicon-based material and a ceramic material.

In some embodiments, the compound electrode assembly further comprises a pair of stabilizing electrodes, each stabilizing electrode being located within the casing and being bonded to an inside surface of the end wall alongside the discharge electrode.

In some embodiments, the stabilizing electrodes are bonded to the inside surface of the end wall through an electrically conductive adhesive or a layer of conductive compound.

In some embodiments, the stabilizing electrodes are arc-shaped and follow an inner boundary of the casing along the side wall.

In some embodiments, the compound electrode assembly further comprises an electron injection electrode mounted outside of the casing and along the side wall, the electron injection electrode being configured to enable injection of free electrons in the plasma chamber.

In some embodiments, the electron injection electrode is L-shaped and includes a first branch extending along the casing and a second branch projecting within the plasma chamber.

In some embodiments, the electron injection electrode is mounted on the outside of the casing through an electrically conductive adhesive, a layer of conductive compound or a ceramic-based bonding compound.

In accordance with another aspect, there is provided a plasma discharge device, comprising: a plasma chamber traversed by a gas flow path allowing a flow of a gas sample through the plasma chamber; and at least one compound electrode assembly, each of said at least one compound electrode assembly comprising: a casing made of a dielectric material, the casing comprising at least one side wall and an end wall defining a closed end; a discharge electrode mounted in the casing, the discharge electrode being bonded to the end wall; and a sealing compound surrounding the discharge electrode and extending within the casing.

In some embodiments, said at least one compound electrode assembly is a pair of compound electrode assemblies.

In some embodiments, the pair of compound electrode assemblies is separated by an adjustable interelectrode spacing.

In some embodiments, the plasma discharge device further comprises a pair of ferrules, each compound electrode assembly being mounted and sealed to a corresponding one of the pair of ferrules.

In some embodiments, each ferrule is made of graphite.

In some embodiments, the plasma discharge device further comprises a pair of Belleville springs, each Belleville spring being in mechanical contact with a corresponding one of the pair of compound electrode assemblies.

In some embodiments, the dielectric material is selected from the group consisting of quartz, borosilicate, ceramics and Teflon®.

In some embodiments, said at least one side wall is a tubular side wall.

In some embodiments, the end wall is a dielectric barrier of a plasma-generating mechanism of the plasma discharge device.

In some embodiments, the end wall projects within the plasma chamber.

In some embodiments, the end wall faces towards the plasma chamber.

In some embodiments, the discharge electrode is made of aluminum or platinum.

In some embodiments, the discharge electrode is bonded to the end wall with an electrically conductive adhesive or a layer of conductive compound, extending along an inside surface of the end wall.

In some embodiments, the discharge electrode comprises a disk-shaped base portion and a cylindrical-shaped lead portion.

In some embodiments, the sealing compound bonds the discharge electrode to the side wall.

In some embodiments, the sealing compound is made of a material selected from the group consisting of silicon-based potty, a ceramic with glass filler, an epoxy putty, a silicon-based material and a ceramic material.

In some embodiments, each of said at least one compound electrode assembly further comprises a pair of stabilizing electrodes, each stabilizing electrode being located within the casing and being bonded to an inside surface of the end wall alongside the discharge electrode.

In some embodiments, the stabilizing electrodes are bonded to the inside surface of the end wall through an electrically conductive adhesive or a layer of conductive compound.

In some embodiments, the stabilizing electrodes are arc-shaped and follow an inner boundary of the casing along the side wall.

In some embodiments, the plasma discharge device further comprises an electron injection electrode mounted outside of the casing and along the side wall, the electron injection electrode being configured to enable injection of free electrons in the plasma chamber.

In some embodiments, the electron injection electrode is L-shaped and includes a first branch extending along the casing and a second branch projecting within the plasma chamber.

In some embodiments, the electron injection electrode is mounted on the outside of the casing through an electrically conductive adhesive, a layer of conductive compound or a ceramic-based bonding compound.

In accordance with another aspect, there is provided a plasma discharge device, comprising: a plasma chamber; a hollow electrode assembly, comprising: a rod made of an insulating material, the rod being traversed by a gas channel extending longitudinally therethrough to introduce a gas sample into the gas chamber; and at least one other electrode assembly.

In some embodiments, said at least one other electrode assembly is a compound electrode assembly, the compound electrode assembly extending through the gas channel and comprising: a casing made of a dielectric material, the casing comprising at least one side wall and an end wall defining a closed end; a discharge electrode mounted in the casing, the discharge electrode being bonded to the end wall; and a sealing compound extending within the casing and surrounding the discharge electrode In some embodiments, the dielectric material is selected from the group consisting of quartz, borosilicate, ceramics and Teflon®.

In some embodiments, said at least one side wall is a tubular side wall.

In some embodiments, the end wall is a dielectric barrier of a plasma-generating mechanism of the plasma discharge device.

In some embodiments, the end wall projects within the plasma chamber.

In some embodiments, the end wall faces towards the plasma chamber.

In some embodiments, the discharge electrode is made of aluminum or platinum.

In some embodiments, the discharge electrode is bonded to the end wall with an electrically conductive adhesive or a layer of conductive compound, extending along an inside surface of the end wall.

In some embodiments, the discharge electrode comprises a disk-shaped base portion and a cylindrical-shaped lead portion.

In some embodiments, the sealing compound bonds the discharge electrode to the side wall.

In some embodiments, the sealing compound is made of a material selected from the group consisting of silicon-based putty, a ceramic with glass filler, an epoxy putty, a silicon-based material and a ceramic material.

In some embodiments, the plasma discharge device further comprises a pair of stabilizing electrodes, each stabilizing electrode being located within the casing and being bonded to an inside surface of the end wall alongside the discharge electrode.

In some embodiments, the stabilizing electrodes are bonded to the inside surface of the end wall through an electrically conductive adhesive or a layer of conductive compound.

In some embodiments, the stabilizing electrodes are arc-shaped and follow an inner boundary of the casing along the side wall.

In some embodiments, the plasma discharge device further comprises an electron injection electrode mounted outside of the casing and along the side wall, the electron injection electrode being configured to enable injection of free electron in the plasma chamber.

In some embodiments, the electron injection electrode is L-shaped and includes a first branch extending along the casing and a second branch projecting within the plasma chamber.

In some embodiments, the electron injection electrode is mounted on the outside of the casing through an electrically conductive adhesive, a layer of conductive compound or a ceramic-based bonding compound.

In accordance with another aspect, there is provided a compound electrode assembly for a plasma discharge device, comprising a casing made of a dielectric material, the casing including at least one side wall, a closed end provided with an end wall and an open end opposite the closed end; a discharge electrode provided inside the casing and being bonded to the end wall on the inside of the casing; and a sealing compound extending within the casing, surrounding the discharge electrode and bonding the discharge electrode to an inside of the side wall.

In some embodiments, the compound electrode further includes a pair of stabilizing electrodes, each stabilizing electrode being located within the casing and being bonded to the inside of the end wall alongside the discharge electrode.

In some embodiments, the stabilizing electrodes may be arc-shaped and follow the boundary of the casing along the side wall.

In accordance with some implementations, the compound electrode assembly may further include an electron injection electrode. Each electron injection electrode can be mounted on the outside of the casing, along the side wall thereof.

In some implementations, the electron injection electrode may be L-shaped and include a first branch extending along the casing and a second branch projecting within the plasma chamber.

In accordance with another aspect, there is provided a plasma discharge device provided with one or more compound electrodes as described herein.

In some implementations, there is also provided a hollow electrode assembly for a plasma discharge device having a plasma chamber including a rod made of quartz or other insulating material, the rod being traversed by a gas channel extending longitudinally therethrough and serving as an inlet path to introduce a gas sample into the plasma chamber; and a wire discharge electrode extending through the gas channel.

Other features and advantages of the invention will be better understood upon reading of preferred embodiments thereof with reference to the appended drawings.

DETAILED DESCRIPTION

The present description concerns electrode assemblies for use in plasma generating mechanisms of plasma discharge block cell assemblies or plasma discharge devices. The description also relates to plasma discharge devices including such electrode assemblies.

Referring to the appended figures, there are schematically illustrated examples of a plasma discharge devices 20 including compound electrodes as described herein. In some implementations, the plasma discharge device 20 may be a plasma-based detector such as described in international patent application published under number WO2016/141463, the entire content of which is incorporated herein by reference. The plasma discharge device may alternatively be used in various other applications where generation of a plasma is relevant, such as for example a plasma chemical reactor or other devices involving the creation of a plasma discharge. In some variants, the plasma discharge device may be used in the context of analytical applications at either low temperature (for example, and without being limitative, less than ambient) or high temperature (for example, and without being limitative, up to about 450° C.), to create a complete high-performance discharge cell.

Figure 1A:
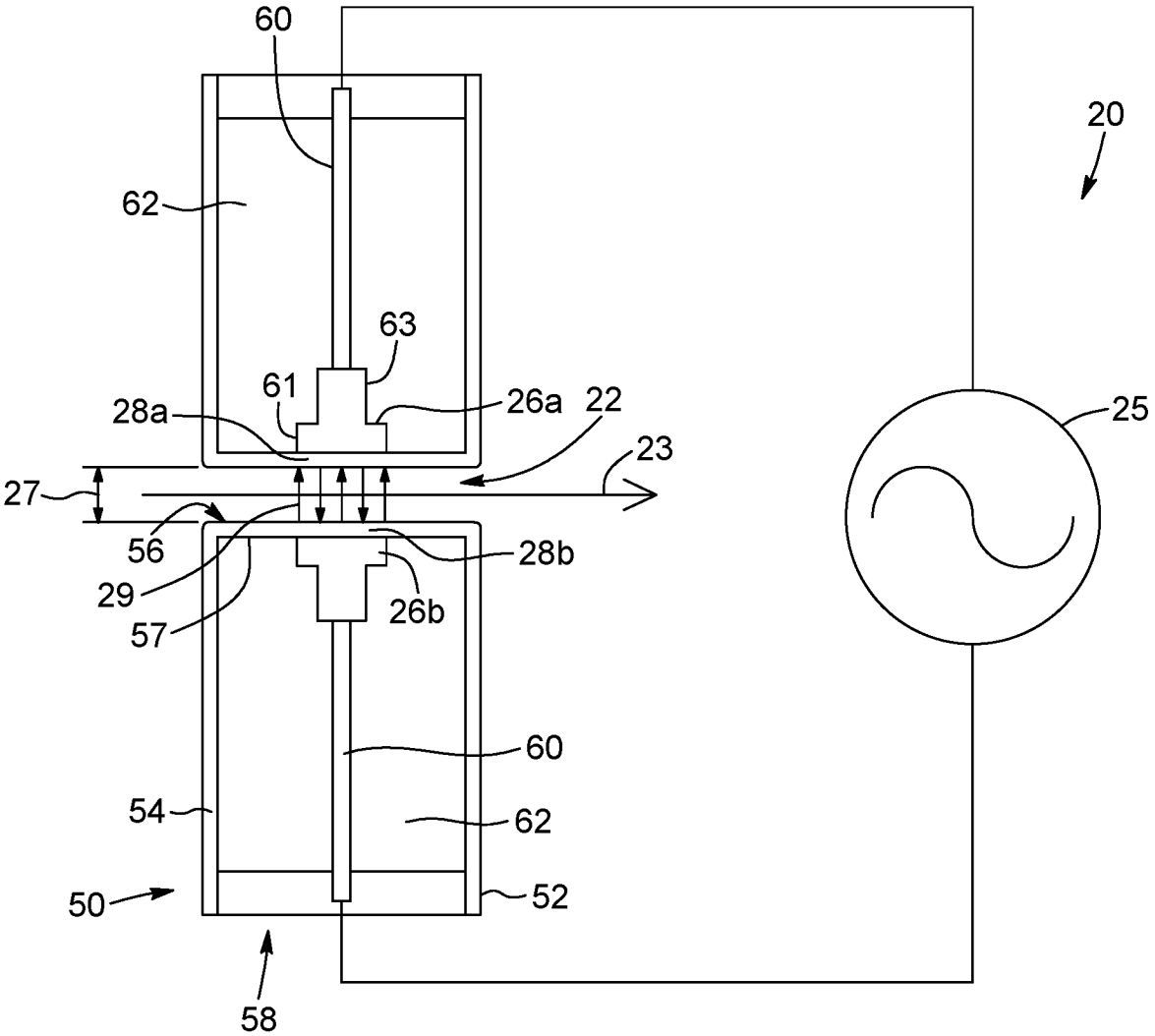
FIGS. 1A-B illustrate a plasma discharge device including a plasma chamber traversed by a gas flow path allowing a flow of a gas sample through the plasma chamber, in accordance with one embodiment.
Figure 1B:
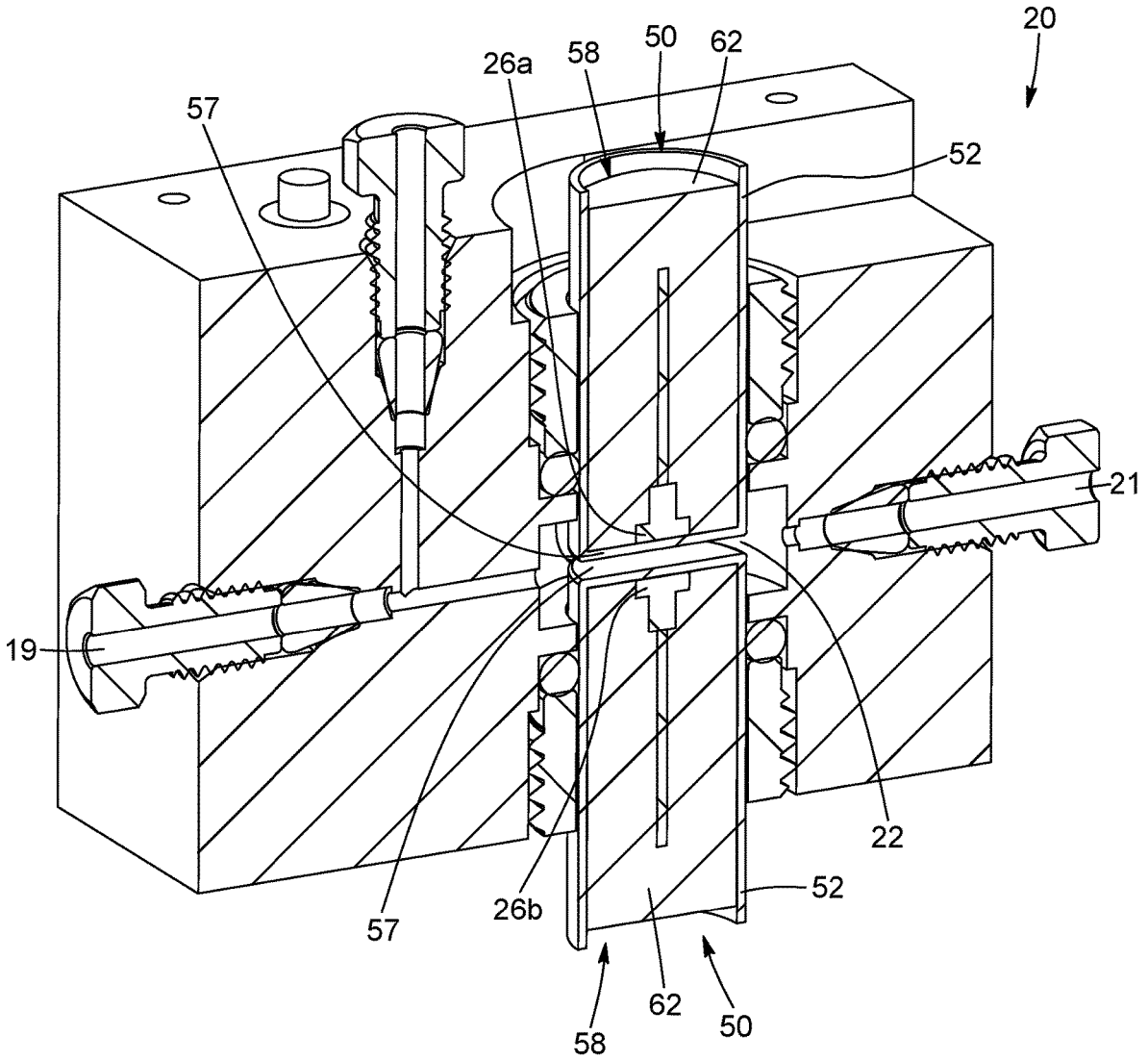

Referring more particularly to FIGS. 1A and 1B, the plasma discharge device 20 first includes a plasma chamber 22 traversed by a gas flow path 23 allowing a flow of a gas sample through the plasma chamber 22. The plasma discharge device includes a gas inlet 19 and a gas outlet 21, allowing circulation of a gas sample through the device 20 along the gas flow path. The plasma chamber 22 may be embodied by any enclosure suitable to host a plasma. In some embodiments, the plasma chamber 22 may be entirely made of quartz. In other embodiments, the plasma chamber may be made of another transparent or non-transparent material, such as, for example and without being limitative, glass-type materials including ceramics, borosilicate glasses or semi-crystalline polymers. An example of semi-crystalline polymers is, for example and without being limitative, polyether ether ketone (PEEK). In some implementations, the plasma chamber 22 may be provided with one of more windows (not shown) allowing visual observation of the plasma and/or collection of optical emissions from the plasma. The windows may for example, and without being limitative, include quartz, calcium fluorite ($CaF_2$) or magnesium fluoride ($MgF_2$) which can be particularly transparent to IR radiation, zinc selenide (ZnSe) materials for measurements in the infrared spectrum, and the like. In other implementations, one or more of the windows may be made of fluorescent glass.

The plasma discharge device 20 further includes a plasma-generating mechanism configured to apply a plasma-generating field 29 across the plasma chamber 22 intersecting the gas flow path 23, so as to generate a plasma from the gas sample. The plasma-generating mechanism includes a pair of discharge electrodes 26*a*, 26*b*. Each discharge electrode 26*a*, 26*b* may be imbedded into a compound electrode assembly 50 as described herein. Although both discharge electrodes 26*a*, 26*b* are shown as part of a corresponding compound electrode assembly 50 in the illustrated embodiments, it will be readily understood that in some variants only one compound electrode assembly 50 may be provided and associated with one of the discharge electrodes 26*a*, 26*b*, the other discharge electrode 26*b*, 26*a* being part of a different configuration.

In some implementations, the plasma-generating mechanism relies on a Dielectric Barrier Discharge (DBD). In DBD, the discharge electrodes 26*a*, 26*b* are separated by a discharge gap 27, in which is provided one or more insulating dielectric barrier 28*a*, 28*b*. In some implementations, at least one of the dielectric barriers may be part of the compound electrode assembly associated with the corresponding discharge electrode, as explained further below. In some implementations, one or more walls of the plasma chamber 22 may also act as the dielectric barrier or barriers of the DBD process. A flow of a gas sample, suitable to break down under an applied electrical field, is circulated along the gas flow path 23 through the discharge gap 27. A plasma discharge generator or alternating current generator 25 provides a high voltage alternating current (AC) driving signal to the discharge electrodes 26*a*, 26*b*. As this AC discharge driving signal is applied to the discharge electrodes 26*a*, 26*b*, the dielectric material of the dielectric barrier 28*a*, 28*b* (for example quartz) polarizes and induces a plasma-generating electrical field 29 in the discharge gap 27, leading to the breakdown of the discharge gas and the creation of a plasma medium in the discharge gap 27. This high ignition potential produces ionisation of the gas and the resulting electrons and ions travel towards the opposite polarity discharge electrodes 26*a*, 26*b*, charging the respective discharge electrodes 26*a*, 26*b* positively and negatively, producing a decrease of the applied electrical potential that in turn conducts to extinguish the plasma. The presence of the dielectric barrier limits the average current density in the plasma. It also isolates the discharge electrodes 28*a*, 26*b* from the plasma, avoiding sputtering or erosion. When the discharge driving signal polarity is reversed, the applied potential and the memory potential due to charge accumulation on the surface of the dielectric barriers 28*a*, 28*b* are added and the discharge starts again. The potential required to sustain the plasma is therefore lower than the initially required potential for ignition.

The plasma-generating process therefore begins with the application of a plasma-generating electrical field 29 across the plasma chamber 22 that transfers enough energy to free electrons in the discharge gap 27 so that they ionise particles of the gas sample through collisions. From that point an avalanche occurs and other ionisation mechanisms can take place. Such mechanisms include, but are not limited to:

- Direct ionization by electron impact. This mechanism involves the ionization of neutral and previously unexcited atoms, radicals, or molecules by an electron whose energy is high enough to provide the ionization act in one collision. These processes can be dominant in cold or non-thermal discharges, where electrical fields and therefore electron energies are quite high, but where the excitation level of neutral species is relatively moderate;
- Ionization by collision of heavy particles. This takes place during ion-molecule or ion-atom collisions, as well as in collisions of electronically or vibrationally excited species, when the total energy of the collision partners exceeds the ionization potential. The chemical energy of colliding neutral species can also contribute to ionization in so-called associative ionization processes;
- Photoionization refers to the excitation of neutral species or particles by photons, which results in the formation of an electron-ion pair. Photoionization can be dominant in thermal plasmas but may also play a significant role in regard to the mechanisms of propagation of non-thermal discharges, due to UV radiation;
- Surface ionization (electron emission). This process is provided by electron, ion, and photon collisions with different surfaces or simply by surface heating; and
- Penning ionization is a two-step ionisation process involving a gas mixture. For example, the gas detector may operate with a doping gas such as helium or argon added to the detector entrance and mixed to the flow of a carrier gas. Direct ionisation by electron impact first provides excited atoms (i.e. metastables). These electronically excited atoms interact with a target molecule, the collision resulting in the ionization of the molecule yielding a cation, an electron, and a neutral gas molecule, in the ground state.

One skilled in the art will readily understand that the peak voltage and frequency of the alternating current generated by the plasma discharge generator 25 is preferably selected in view of the nature of the discharge gas and operating conditions in the plasma chamber 22, in order to favor breakdown of the discharge gas and generation of a plasma suitable for a target application. The peak voltage required to create a discharge depends on several application-specific factors, such as the ease of ionisation of the discharge gas. For example, at atmospheric pressure, helium requires a voltage of about 2 kV peak to peak, whereas argon requires about 4 kV and nitrogen up to 10 kV. Operating at lower pressure can significantly decrease the required voltage to achieve ionisation. The waveshape of the alternating discharge driving signal may for example be square or sinusoidal. In one embodiment, the use of a medium frequency sinusoidal shape driving signal, for example under 1 MHz, has been found to reduce spurious harmonics generated by the system. Finally, the frequency of the alternating discharge driving signal may also be used as a parameter to control and/or improve the plasma-generating process. As will be readily understood by one skilled in the art, variations in the frequency of the discharge driving signal will directly impact the intensity of the plasma, and therefore the intensity of the optical emissions from the plasma. Indeed, the higher the excitation frequency, the stronger the resulting plasma-generating field, and therefore the greater the movement of the electron within the plasma chamber back and forth between the discharge electrodes. This parameter therefore has a direct impact on the strength of the light emitted from the plasma, and therefore increases the intensity of the detected signal for a same quantity of impurities in the flow of the gas sample.

As will be readily understood by one skilled in the art, the plasma generated through DBD configurations such as described herein typically constitutes a "soft plasma" maintained in a non-thermal equilibrium regime. In such plasma, the momentum transferred between electrons and heavy particles such as ions and neutral particles is not efficient, and the power coupled to the plasma favors electrons. The electron temperature ($T_e$) is therefore considerably higher than the temperatures associated with ion ($T_i$) and neutral particles ($T_n$). In other words, the electrical energy coupled into the plasma is mainly transferred to energetic electrons, while the neutral gas and ions remain close to ambient temperature and exploit the more appropriate behaviour, characteristic or phenomenon of the plasma discharge.

It will be readily understood that the properties of the generated plasma depend on the nature of the gas being ionised to generate the discharge. In chromatographic applications, the carrier gas used in the chromatographic process typically dominates the plasma-generation process. Typical carrier gas used such as argon or helium can provide a usable plasma at atmospheric or high pressure. Argon generally creates a "streamer"-type discharge, whereas helium results in a "glow"-type discharge. Both types of discharge may be used in the context of embodiments of the present invention. Furthermore, as will be explained below, in some implementations the generated plasma may be based on other gases, including gases more difficultly ionised at atmospheric pressure, such as $N_2$, $H_2$, $O_2$, $CO_2$ and the like.

By way of example, in the context of plasma discharge devices used as gas detectors, the discharge gas is embodied by the gas sample passing through the plasma chamber 22 along the gas flow path 23. As mentioned above, the gas sample may for example be embodied by solutes from a gas chromatography system, or other gas samples whose composition is to be analysed. Typically, the gas sample includes a carrier gas of a known nature (such as, for example and without being limitative, He, Ar, $N_2$, $CO_2$, $H_2$ and $O_2$), in which are present impurities to be identified and/or measured. As mentioned above, the impurities may for example be embodied by hydrocarbons, $H_2$, Ar, $O_2$, $CH_4$, CO, $CO_2$, $H_2O$, BTEX compounds, and the like.

Still referring to FIGS. 1A and 1B, in accordance with one aspect there is provided one or more compound electrode assemblies 50. In the illustrated embodiment, each compound electrode assembly 50 includes a casing 52 made of a dielectric material such as quartz, borosilicate, ceramics, Teflon® or any other materials having the required properties. The casing 52 may be tube-shaped and may include a tubular side wall 54. The casing also includes an end wall 57 defining a closed end 56. As illustrated, the casing 52 includes an open end 58 opposite the closed end 56. The casing 52 may also be referred herein as a closed-end tubing. In some embodiments, the side wall 54 can be a tubular side wall. The casing 52 is adapted to be positioned with the closed-end 56 projecting within the plasma chamber 22 or facing towards the plasma chamber 22, while the opposite open end 58 faces away from the plasma chamber 22. One of the discharge electrodes 26*a*, 26*b* is provided inside the casing and is preferably bonded to the end wall 57 on the inside of the casing 52, for example through an electrically conductive adhesive, or by a layer of conductive compound extending along the surface of the end wall 57. The discharge electrode 26*a*, 26*b* is made of a conductive material, for example a metal such as copper, aluminum, platinum or the like. In this configuration, the end wall 57 may act as the dielectric barrier 28*a*, 28*b* of the DBD plasma-generating process. The other extremity of the discharge electrode 26*a*, 26*b* projects towards the open end 25 of the casing 52 and is connected to a lead wire 60, which is itself connected to the plasma discharge generator 25. The discharge electrode 26*a*, 26*b* may have any suitable shape, and in the illustrated embodiment includes a disk-shaped base portion 61 bonded to the end wall 57 and a cylindrical-shaped lead portion 63 of smaller diameter than the disk-shaped base portion 61.

A sealing compound 62 extends within the casing 52 surrounding the corresponding discharge electrode 26*a*, 26*b* and bonding this electrode to the inside of the side wall 54 of the casing 52. The sealing compound 62 preferably fills all the space inside the casing 52 which is free of electrodes, wires or other components. The sealing compound 62 therefore seals the casing 52 and the discharge electrode 26*a*, 26*b* within from ambient air. The sealing compound 62 may be embodiment by any suitable material, such as for example a silicon-based putty, a ceramic with glass filler, an epoxy putty or other similar materials. By way of example, in embodiments for ambient temperature operation, a silicone-based material may be used, whereas for high-temperature operation a ceramic-based material may be preferred.

In some implementations, the plasma discharge device may be further configured to apply a stabilizing or localizing electrostatic or electromagnetic field. As the plasma within the plasma chamber is a charged medium, it can be extended, compressed or moved under the influence of such fields. Advantageously, such a localizing field can limit the substantial displacement or movement of the plasma which may otherwise occur within the plasma chamber an interfere with the detection or other process. Such a displacement can for example be present under particular operating conditions such as sudden flow change, high pressure, a high level of impurities inside the plasma chamber or when the plasma operating power is low. The type of discharge gas used to generate the plasma can also influence the spatial stability of the generated discharge. Under such conditions, the discharge may exhibit what may look, even to the naked eye, like turbulence. For some applications, the movement of the plasma within the plasma chamber can have a significant impact on the process of detecting and analysing the generated radiation. Over the course of a discharge, movements of the plasma within the plasma chamber can displace the plasma in and out of alignment with one or more windows, affecting the proportion of the generated radiation collected through such windows.

Figure 2B:
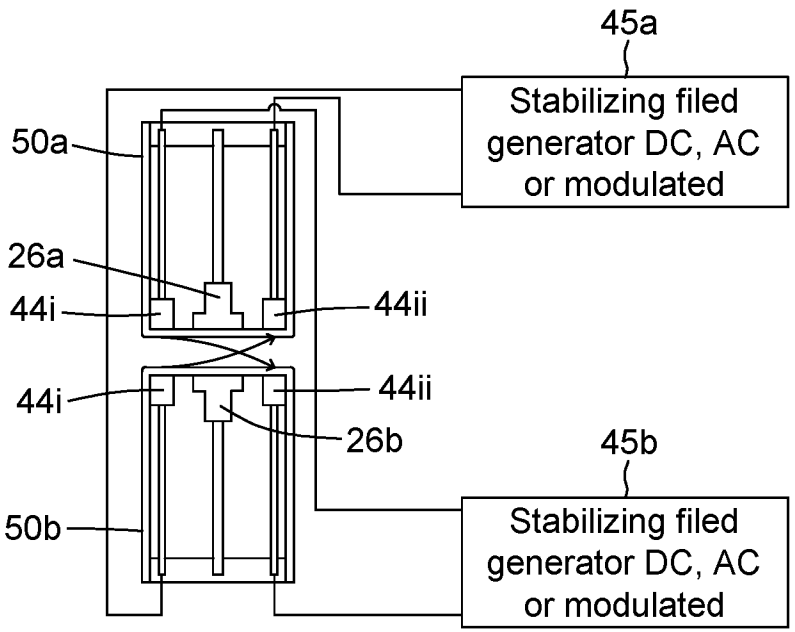
FIGS. 2A-C illustrate a plasma discharge device including stabilizing electrodes configured to apply a stabilizing field across a plasma chamber, in accordance with some embodiments.
Figure 2A:
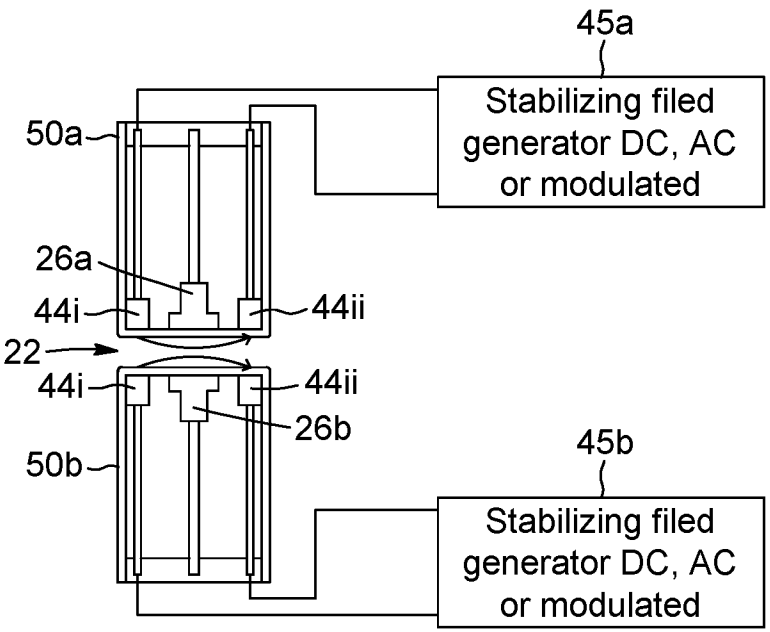
Figure 2C:
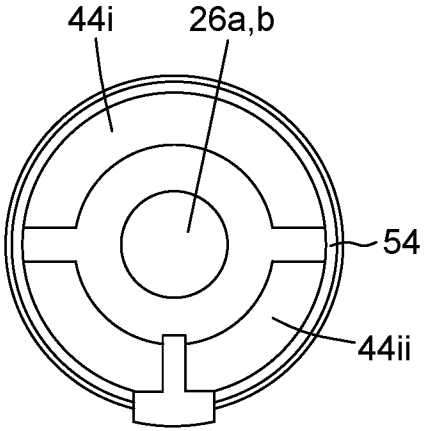

Referring to FIGS. 2A, 2B and 2C, the plasma discharge device 20 may include stabilizing electrodes 44 configured to apply a stabilizing field across the plasma chamber 22.

In some embodiments, each compound electrode assembly 50 may include a pair of stabilizing electrodes 44*i* and 44*ii*. Each stabilizing electrode 44*i* and 44*ii* is located within the casing 52 and is bonded to the inside of the end wall 57 alongside the corresponding discharge electrode 26*a*, 26*b*, for example through an electrically conductive adhesive, or by a layer of conductive compound extending along the surface of the end wall 57. In the illustrated embodiment, each stabilizing electrode 44*i*, 44*ii* is arc-shaped and follows the boundary of the casing 50 along the side wall 54 (see for example FIG. 2C).

Controlling and managing the electrical field between the stabilizing electrodes may provide an improved control of the stability and position of the plasma. Depending on the polarity of the plasma, the electrodes may be both negative, both positive or one electrode negative and the other positive. As the plasma within the chamber 22 is a charged medium, its position will be controlled by the electrical field between the stabilizing electrodes 44*a*, 44*b*, helping maintain its spatial distribution. This in turn stabilizes the alignment of the plasma with the windows, ensuring the stability of the light collection through these windows. More information on the use of a plasma-localizing field may for example be found in the aforementioned international patent application published under number WO2016/141463. In some implementations the stabilizing electrode may also be used to create oscillations in the position of the plasma, at a higher frequency than the response bandwidth of the measuring system.

Each stabilizing electrode 44*i*, 44*ii* is electrically connected to a high power supply 45. In one example, the power supply is configured to apply a DC stabilizing drive signal on the stabilizing electrodes 44*i*, 44*ii*, creating an electrostatic field between them. The electrostatic field guides the plasma within the plasma chamber 22, and its strength can be adjusted so that the plasma is in line with one or more windows or other position of interest. In one variant, the power supply may be configured to apply a stabilizing drive signal on the stabilizing electrodes 44*i*, 44*ii* including both a DC component and an AC component. Advantageously, the AC component of the stabilizing drive signal may be synchronized with the discharge driving signal. The AC component may be user-triggered as required.

FIGS. 2A and 2B show two variants of stabilizing electrode configurations in an implementation where the plasma discharge device includes a pair of first and second compound electrode assemblies 50*a* and 50*b* facing each other across the plasma chamber 22, each compound electrode assembly 50*a*, 50*b* including one of the discharge electrodes 26*a*, 26*b* and a corresponding pair of stabilizing electrodes 44*i*, 44*ii* as described above. In the variant of FIG. 2A, the stabilizing electrodes 44*i*, 44*ii* of the first compound electrode assembly 50*a* are both connected to a same high power supply 45*a*. Similarly, the stabilizing electrodes 44*i*, 44*ii* of the second compound electrode assembly 50*b* are both connected to a same high power supply 45*b* such that the stabilizing field created within the plasma chamber. The generated stabilizing field therefore extends between the stabilizing electrodes 44*i* and 44*ii* of a same compound electrode assembly 50*a*, 50*b*, substantially along the plane of the plasma chamber 22. In the variant of FIG. 2B, the stabilizing electrode 44*i* of the first compound electrode assembly 50*a* is coupled to the diagonally opposite stabilizing electrode 44*ii* of the second compound electrode assembly 50*b* through first high power supply 45*a*, and the stabilizing electrode 44*i* of the second compound electrode assembly 50*b* is coupled to the diagonally opposite stabilizing electrode 44*ii* of the first compound electrode assembly 50*a* through second high power supply 45*b*. The resulting stabilizing fields therefore extend across the chamber 22.

Figure 3A:
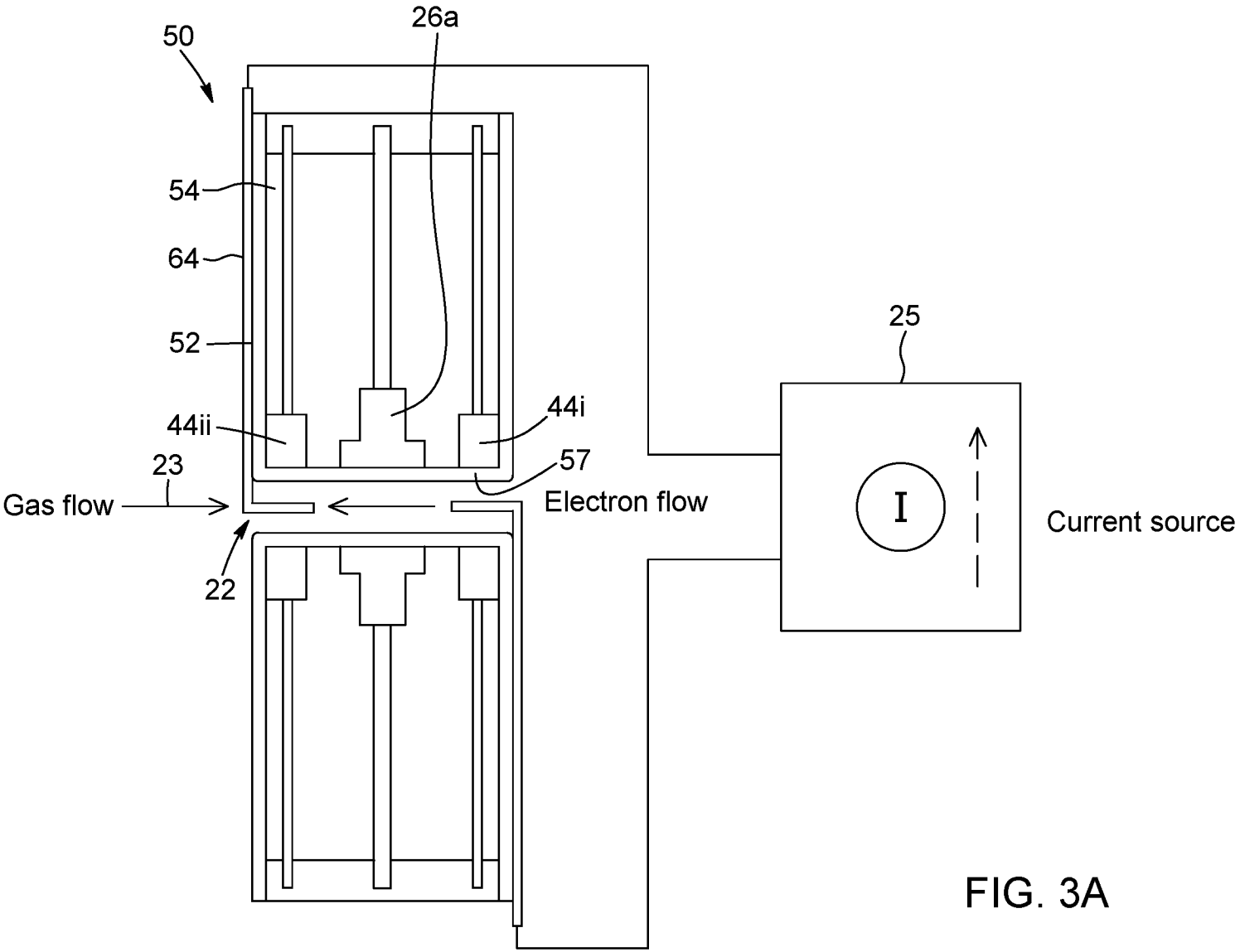
FIGS. 3A-B show a compound electrode assembly including an electron injection electrode, in accordance with one embodiment.
Figure 3B:
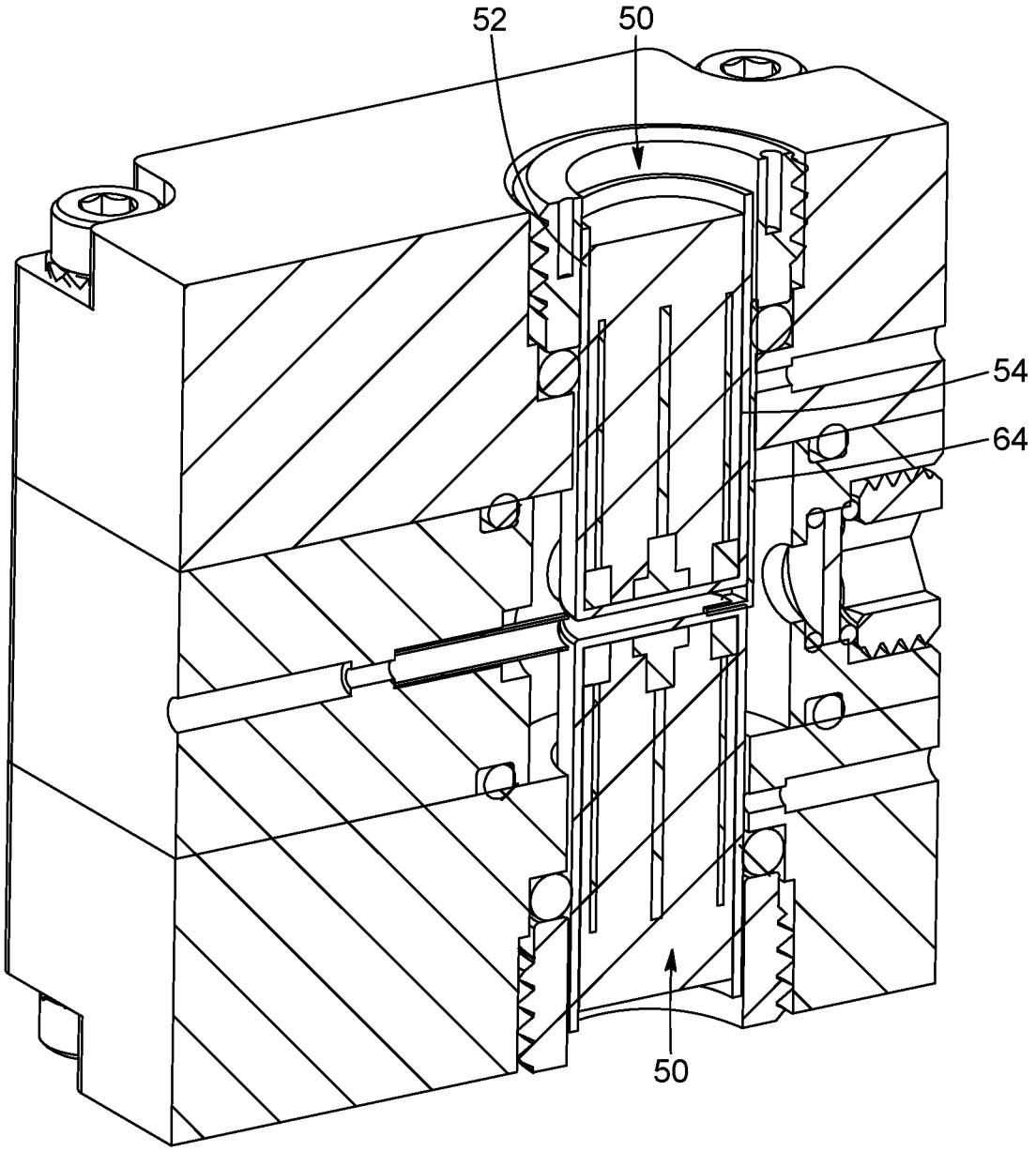
Figure 4C:
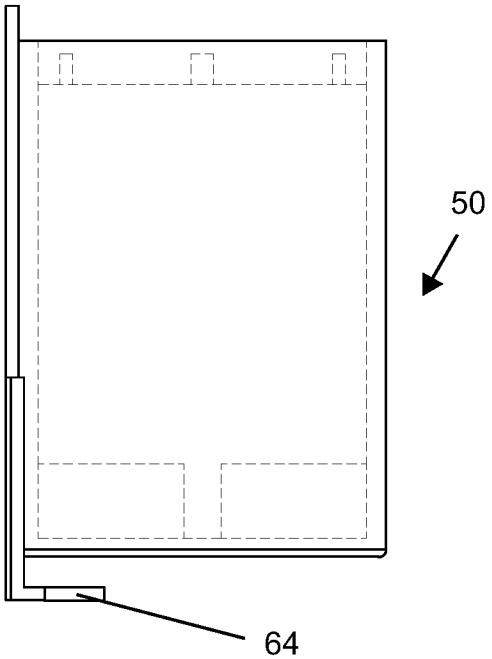
FIGS. 4A-C show a compound electrode assembly configuration including discharge, stabilizing and electron injection electrodes, in accordance with one embodiment.
Figure 4B:
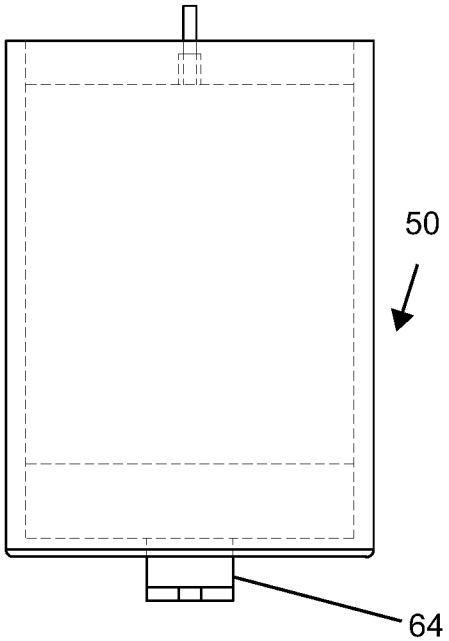
Figure 4A:
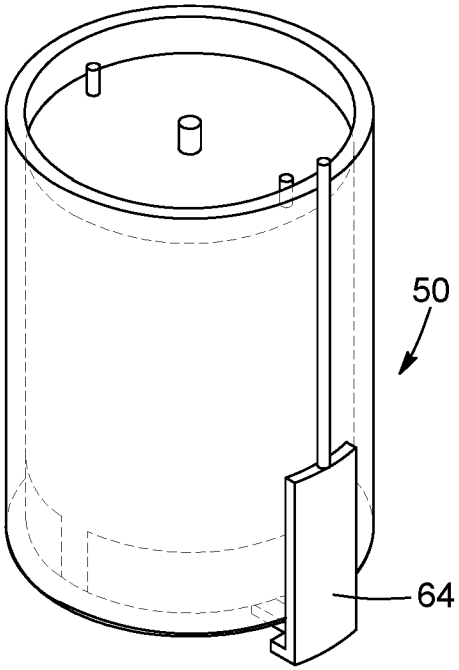
Figure 5:
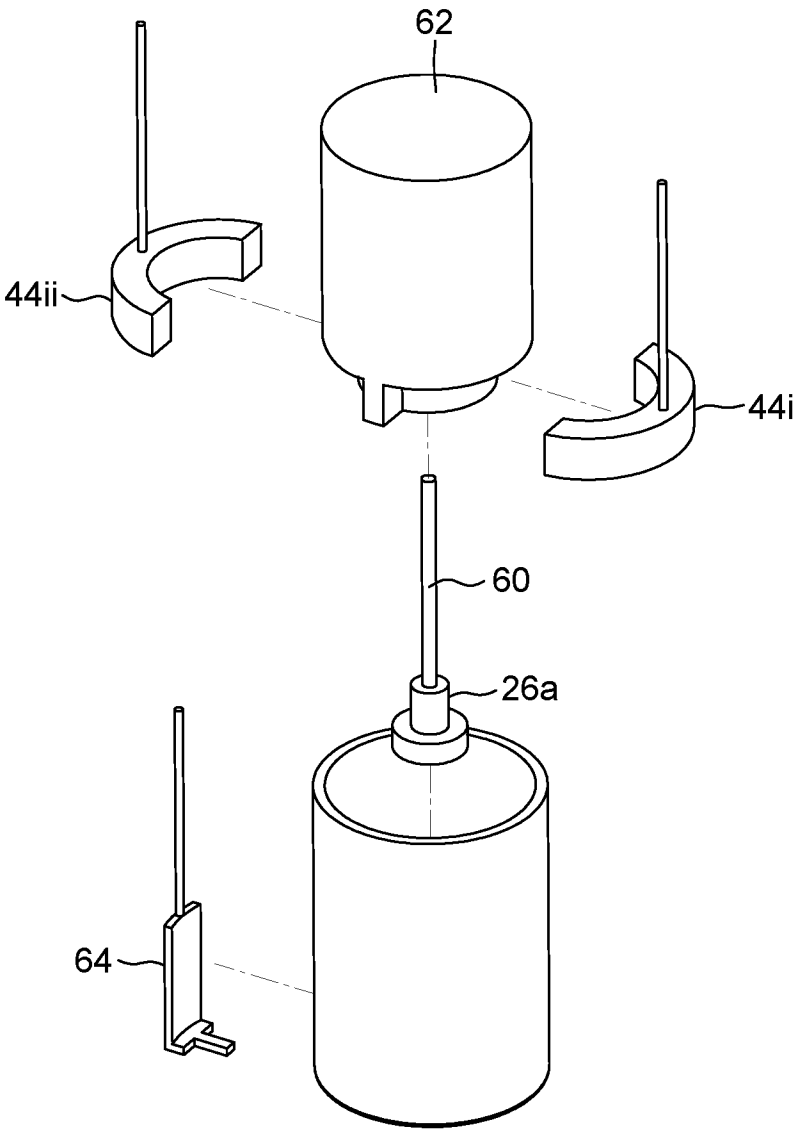
FIG. 5 shows a compound electrode assembly configuration including discharge, stabilizing and electron injection electrodes, in accordance with another embodiment.

Referring to FIGS. 3A and 3B, in accordance with some implementations one or more of the compound electrode assemblies 50 may further include an electron injection electrode 64. Each electron injection electrode 64 is preferably mounted on the outside of the casing 52, along the side wall 54, for example through an electrically conductive adhesive, or by a layer of conductive compound extending along the surface of the side wall 54. In one embodiment, the electron injection electrodes are bonded to the exterior of the side wall 54 by a ceramic-based bonding compound. Each electron injection electrode 64 may be electrically connected to the current source output of the plasma generator 25 or to a different current source. The electron injection electrode 64 are preferably L-shaped and include a first branch extending along the casing 52 and a second branch projecting within the plasma chamber 22 parallelly to the gas flow path 23.

The provision of one or more electron injection electrode 64 can enable the injection of free electrons in the plasma chamber 22, which may be useful in some applications. For example, gas chromatographic systems used for bulk gas measurements typically use helium or argon as carrier gas. Generally speaking, it is relatively easy to start and maintain a plasma discharge in argon or helium, and this, at atmospheric or even higher pressure. Therefore, igniting a plasma when operating with such gases usually involves only routine considerations for one skilled in the art. Typically, this involves applying an initially high voltage to the discharge electrodes 26*a*, 26*b* and when the discharge is ignited, the voltage is decreased in order to maintain a stable plasma. Higher continuous excitation voltage may lead to instability. In some variants, photon assisted starting discharge systems can also be used, as are well known in the art, especially in conjunction with argon or helium as carrier gases. This concept consists in irradiating the discharge gap with photons in the UV range, releasing electrons from the discharge gas through photo-ionisation. The released electrons are accelerated by the excitation field, reducing start up time and voltage. While this approach improves efficiency when working with argon and helium, it is however not the case when working with gases more difficultly ionised at atmospheric pressure, such as $N_2$, $H_2$ and $O_2$, unless a very high intensity beam is used. When using $N_2$, $O_2$ or $H_2$ as carrier gas, an intense initial voltage is required to start the plasma and once it has started, the discharge is not typically stable and tends to shut down by itself if there is a sudden flow change or pressure upset in the plasma chamber. Operation of a plasma-based device using hard to ionise carrier gases may be facilitated by the injection of free electrons in the plasma chamber. Indeed, it is believed that the lack of free electrons in hard to ionise gases is a factor affecting the stability of the discharge.

In some implementations, another use of electron injection electrode 64 may be to monitor the plasma impedance that could be used to measure impurities, or to detect if the plasma discharge is on the "ON" phase. These electrodes could also be used to start or spark the plasma, when the gas pressure is relatively high, 100 PSIG for example.

It will be readily understood that in various implementations, the compound electrode assembly 50 as described herein may combine some or all of the features described herein. In simple implementations, only the discharge electrode (e.g., 26*a*, 26*b*) may be provided. In some embodiments, the compound electrode assembly may include discharge electrodes and stabilizing electrodes but exclude an electron injection electrode. In other variants, the compound electrode assembly may include an electron injection electrode but exclude stabilizing electrodes. In other variants, such as shown in FIGS. 3A and 3B, all three types of electrodes (discharge, stabilizing and electron injection) may be provided in a same compound electrode assembly 50. FIGS. 4A, 4B, 4C and 5 show an example of a 3D design for such a compound electrode assembly.

It will be readily understood that the disclosed compound electrode assembly may be fitted on plasma chambers having various shapes such as circular, rectangular or simply square. The disclosed compound electrode assembly is furthermore compatible with plasma chambers made of various materials such as stainless steel, PEEK, Teflon® or PPA or ceramic, depending on chemical stability and temperature requirements. Such plasma chambers could be additionally fitted with a viewing aperture or window to monitor plasma emission.

Figure 6:
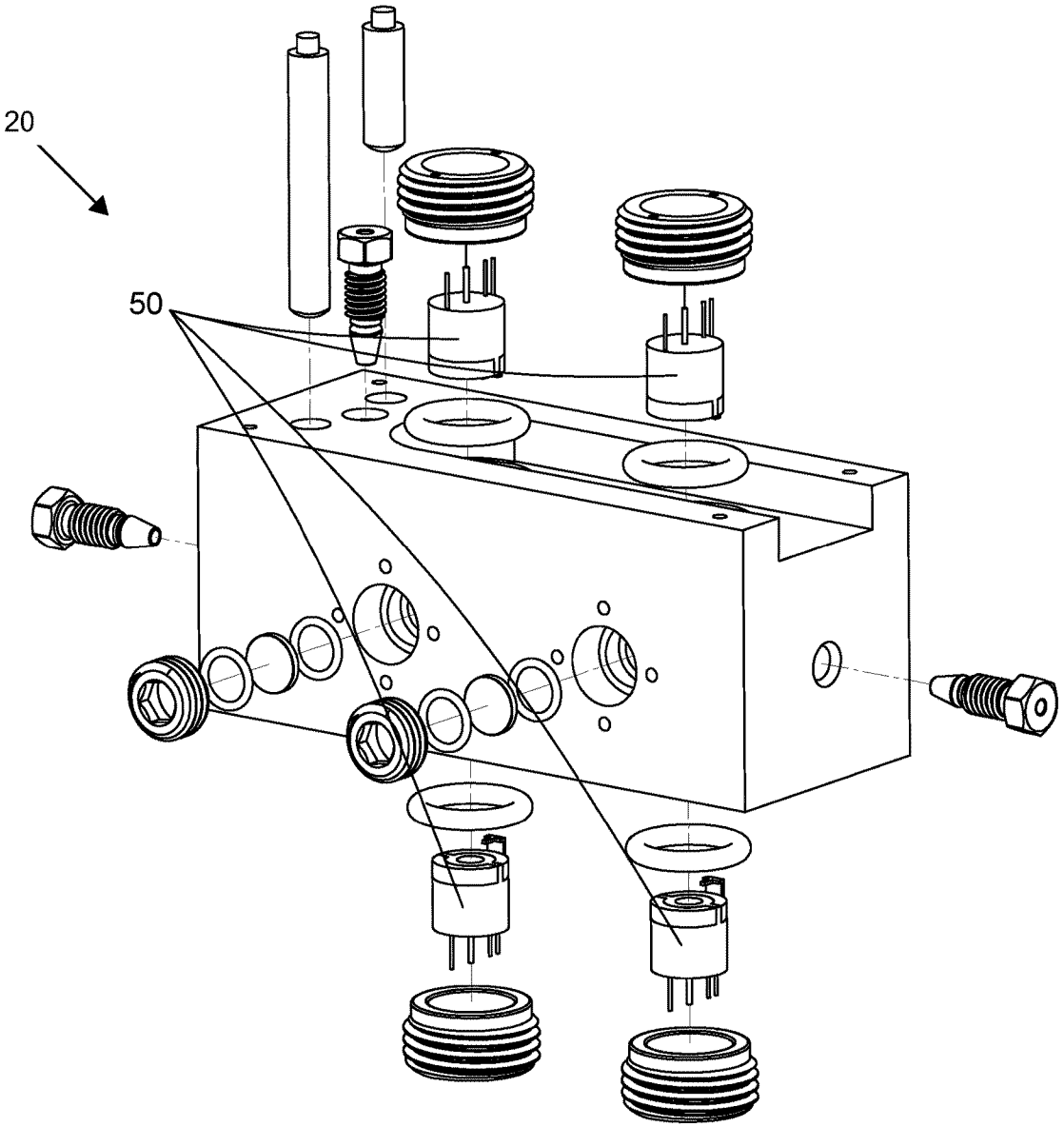
FIG. 6 illustrates a plasma chamber including four compound assemblies, in accordance with one embodiment.

In some embodiments the plasma discharge device 20 may include more than two compound electrode assemblies 50 as described herein. Referring to FIG. 6, there is shown an example of such an embodiment showing four compound electrode assemblies 50 provided on a square-shaped plasma chamber 22.

Figure 7:
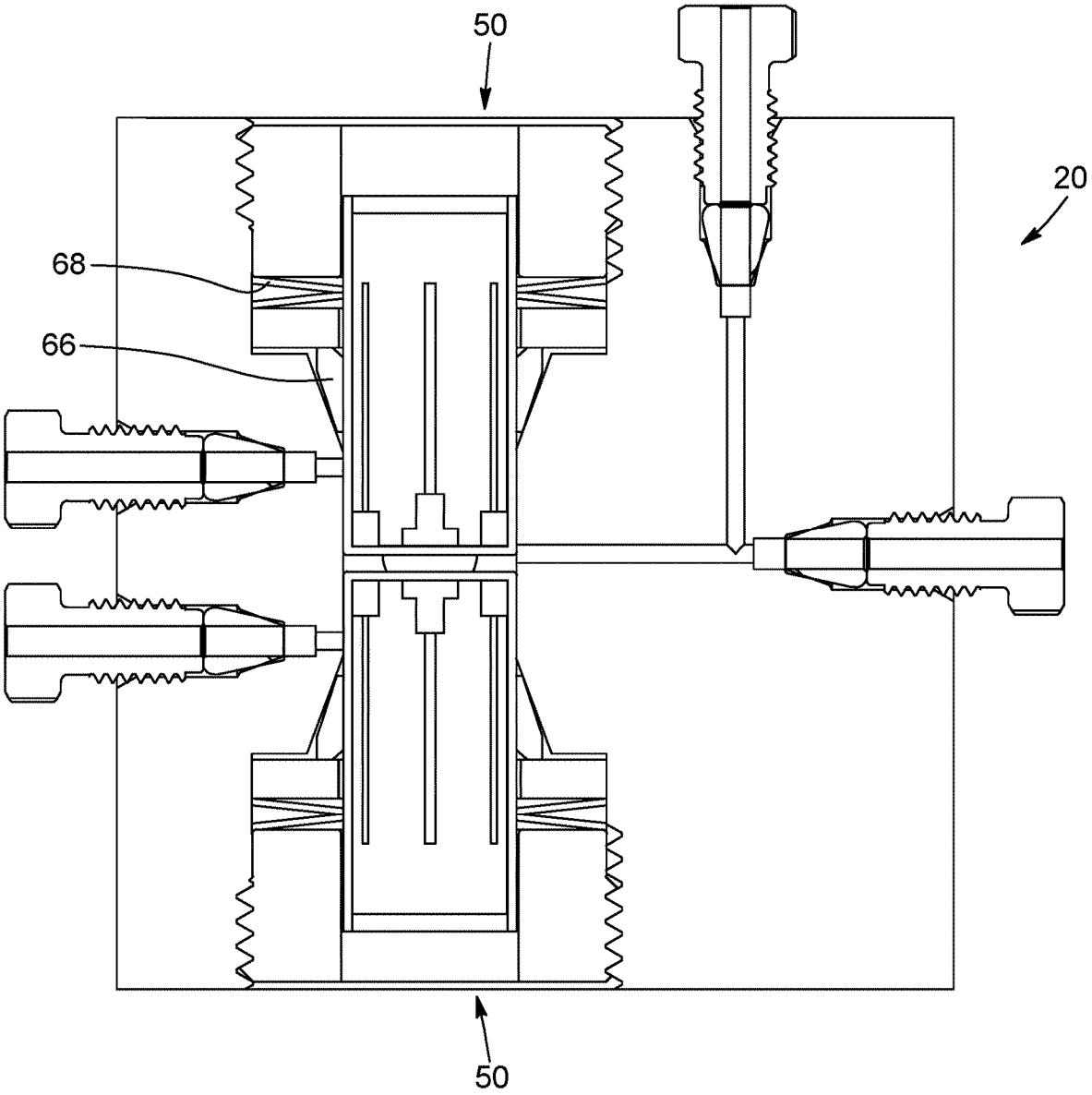
FIG. 7 is an illustration of a plasma chamber, in accordance with another embodiment.

In some implementations, the plasma chamber 22 may be configured to allow the adjustment of the interelectrode spacing between the discharge electrode 26*a*, 26*b*. This could lead to discharge field intensity up to 200 or 400 kV/cm, sufficient, for atomic ionisation. The use of a compound electrode such as described above may enable a chamber design minimizing the spacing between the electrodes and therefore the volume of the plasma chamber. Indeed, compared to designs where the walls of the plasma chamber act as the dielectric barriers of the DBD process, the above-described compound electrodes may be brought closer together. Referring to FIG. 7, is some embodiments, each electrode assembly may be mounted to and sealed in a graphite ferrule 66. A set of Belleville springs 68 may also be used to compress the electrode assembly and maintain a relatively constant pushing force on the ferrule 66. Such a configuration may be particularly adapted for relatively high temperature operation, for example between 350° C. to 450° C.

Figure 8A:
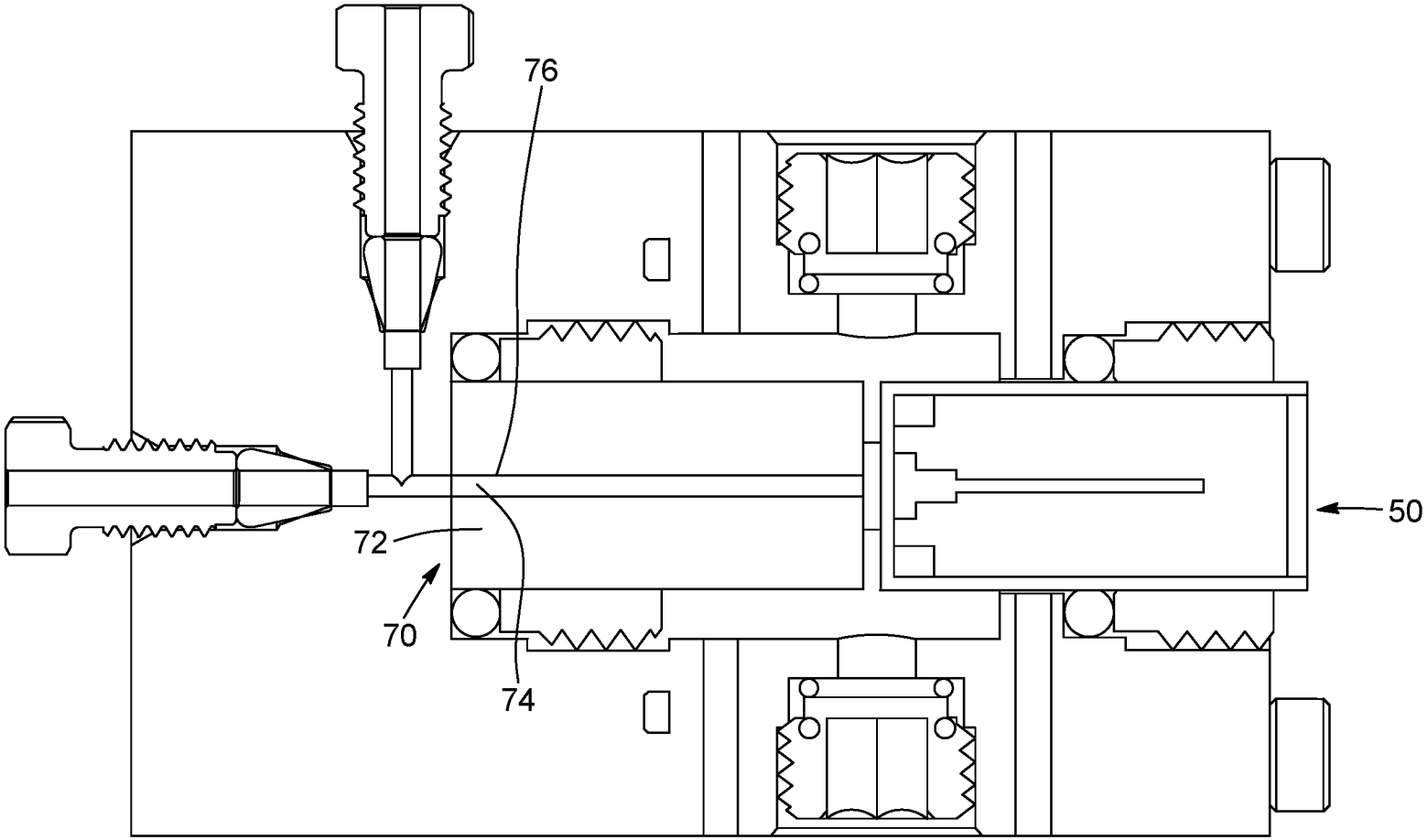
FIGS. 8A-B show a hollow electrode assembly, in accordance with one embodiment.
Figure 8B:
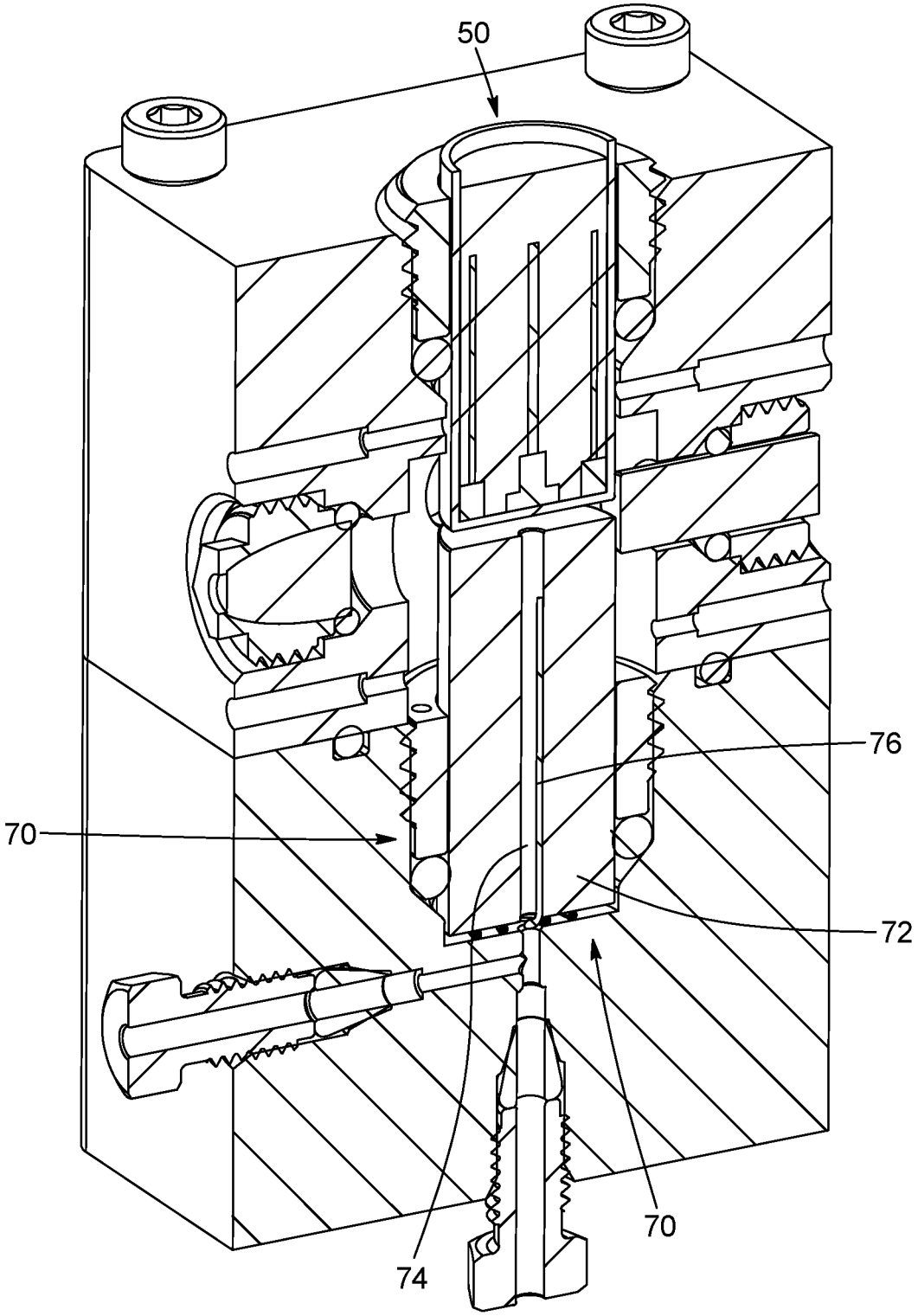

Referring to FIGS. 8A an 8B, in accordance with another aspect there is also provided a hollow electrode assembly 70. The hollow electrode assembly includes a rod 72 made of quartz or other insulating material. The rod 72 is traversed by a gas channel 74 extending longitudinally therethrough. The gas channel 74 serves as an inlet path to introduce the gas sample into the plasma chamber. One of the discharge electrodes 26*a* extends through the gas channel 74. The discharge electrode in this variant is shaped as a metallic wire electrode 76, for example made of iridium and platinum. For example, the wire electrode 76 may be connected to the electrical ground and acts as the grounded discharge electrode. In the illustrated variant, the other discharge electrode 26*b* is part of a compound electrode assembly 50 as described above, provided on the opposite side of the plasma chamber 22 across from the hollow electrode assembly 70. In this configuration, as with previous variants the discharge stabilisation is achieved by the surface field of the discharge electrode 26*b* embedded in the compound electrode assembly 50.

Figure 9:
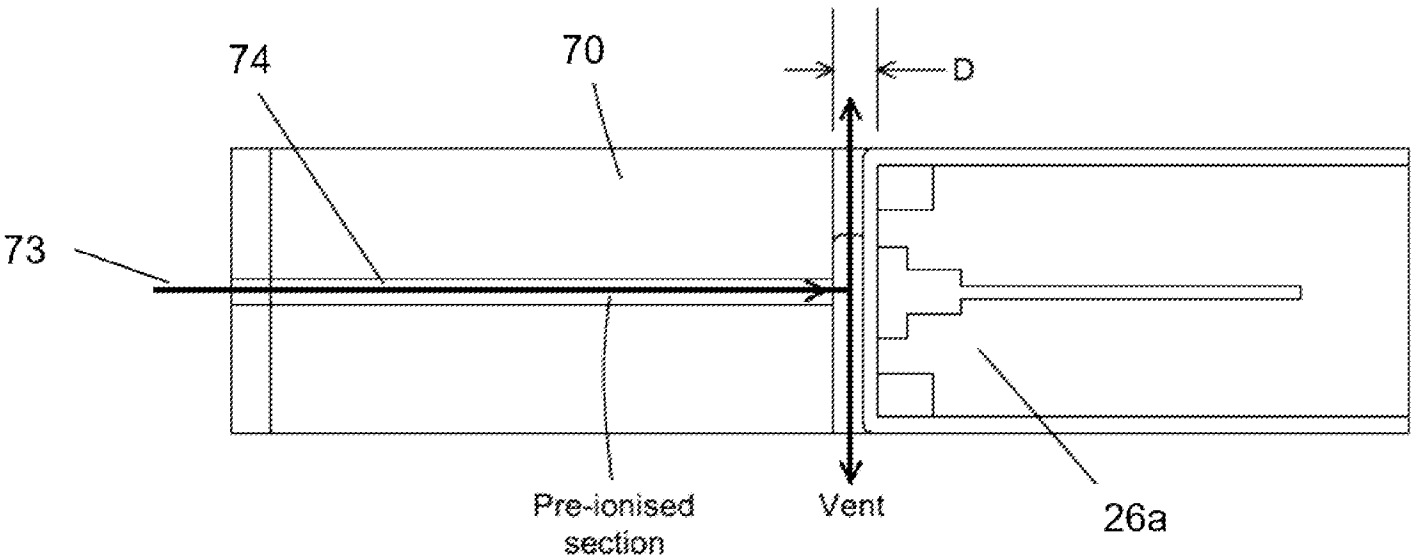
FIG. 9 is a schematic representation of the hollow electrode assembly illustrated in FIGS. 8A-B.

With additional reference to FIG. 9, it can be seen that in this configuration direct introduction of the sample in the plasma discharge zone is provided without any dilution or internal volume effect that can cause peak broadening and reduced sensitivity in a plasma detector context. Furthermore, the fluid dynamic of this design allows the gas evacuation out of the plasma zone discharge, away from the electrodes, as illustrated in FIG. 9.

In some implementations, the hollow electrode assembly 70 such as described above may further provide a pre-ionisation of the gas entering the device. Indeed, the wire electrode 76 in contact with the gas sample circulating through the gas channel 74 will have an ionising effect on some of the particles of the gas sample. Electron injection from the wire electrode 76 may also be provided.

In some variants, the hollow electrode assembly 70 may further include an annular electrode (not shown) embedded into the rod 72 and surrounding the gas channel 74 at the discharge end of the rod 72 (within the plasma chamber 22). The annular electrode creates a capacitive coupling between the gas channel outlet and the main cell body of the plasma chamber, if made of metal, or the steel inlet tubing bringing the gas sample to the gas channel of the hollow electrode assembly 70. The body and inlet tubing are electrically grounded. The device may include an additional pre-ionisation power source (not shown) connected to the annular discharge electrode and the cell body, in case of a steel body, or the metal inlet tubing. It is interesting to note that such an arrangement also supplies extra seed electrons to the main discharge in the analytical zone. Varying the intensity of this secondary floating supply varies the electrons/ions rate generation. When reactant or doping gas is added to the inlet, it also has the benefit of introducing excited species into the analytical zone.

In some implementations, the pre-ionisation of the gas sample could also be started by simply increasing the main plasma generator field driving intensity.

Of course, numerous modifications could be made to the embodiments described above without departing from the scope of protection.

The invention claimed is:

1. A compound electrode assembly for generating a plasma in a plasma chamber of a plasma discharge device, the compound electrode assembly comprising:

a casing made of a dielectric material, the casing comprising at least one side wall and an end wall defining a closed end;

a discharge electrode mounted in the casing, the discharge electrode being bonded to the end wall, wherein the discharge electrode is bonded to the end wall with an electrically conductive adhesive or a layer of conductive compound, extending along an inside surface of the end wall; and a sealing compound surrounding the discharge electrode and extending within the casing.

2. The compound electrode assembly of claim 1, wherein the dielectric material is selected from the group consisting of quartz, borosilicate, ceramics and Polytetrafluoroethylene.

3. The compound electrode assembly of claim 1, wherein said at least one side wall is a tubular side wall.

4. The compound electrode assembly of claim 1, wherein the end wall is a dielectric barrier of a plasma-generating mechanism of the plasma discharge device.

5. The compound electrode assembly of claim 1, wherein the end wall projects within the plasma chamber.

6. The compound electrode assembly of claim 1, wherein the end wall faces towards the plasma chamber.

7. The compound electrode assembly of claim 1, wherein the discharge electrode is made of aluminum or platinum.

8. The compound electrode assembly of claim 1, wherein the discharge electrode comprises a disk-shaped base portion and a cylindrical-shaped lead portion.

9. The compound electrode of claim 1, wherein the sealing compound bonds the discharge electrode to the side wall.

10. The compound electrode assembly of claim 1, wherein the sealing compound is made of a material selected from the group consisting of silicon-based putty, a ceramic with glass filler, an epoxy putty, a silicon-based material and a ceramic material.

11. The compound electrode assembly of claim 1, further comprising a pair of stabilizing electrodes, each stabilizing electrode being located within the casing and being bonded to an inside surface of the end wall alongside the discharge electrode.

12. The compound electrode assembly of claim 1, wherein the pair of stabilizing electrodes are bonded to the inside surface of the end wall through an electrically conductive adhesive or a layer of conductive compound.

13. The compound electrode assembly of claim 11, wherein the stabilizing electrodes are arc-shaped and follow an inner boundary of the casing along the side wall.

14. The compound electrode assembly of any one of claim 1, further comprising an electron injection electrode mounted outside of the casing and along the side wall, the electron injection electron being configured to enable injection of free electron in the plasma chamber.

15. The compound electrode assembly of claim 1, wherein the electron injection electrode is L-shaped and includes a first branch extending along the casing and a second branch projecting within the plasma chamber.

16. The compound electrode assembly of claim 14, wherein the electron injection electrode is mounted on the outside of the casing through an electrically conductive adhesive, a layer of conductive compound or a ceramic-based bonding compound.

17. A plasma discharge device, comprising:

a plasma chamber traversed by a gas flow path allowing a flow of a gas sample through the plasma chamber; and at least one compound electrode assembly, each of said at least one compound electrode assembly comprising:

a casing made of a dielectric material, the casing comprising at least one side wall and an end wall defining a closed end;

a discharge electrode mounted in the casing, the discharge electrode being bonded to the end wall;

a sealing compound surrounding the discharge electrode and extending within the casing; and wherein said at least one compound electrode assembly is a pair of compound electrode assemblies, the pair of compound electrode assemblies being separated by an adjustable interelectrode spacing.

18. The plasma discharge device of claim 17, further comprising a pair of ferrules, each compound electrode assembly being mounted and sealed to a corresponding one of the pair of ferrules.

19. The plasma discharge device of claim 18, wherein each ferrule is made of graphite.

20. The plasma discharge device of claim 18, further comprising a pair of Belleville springs, each Belleville spring being in mechanical contact with a corresponding one of the pair of compound electrode assemblies.

21. A compound electrode assembly for generating a plasma in a plasma chamber of a plasma discharge device, the compound electrode assembly comprising:

a casing made of a dielectric material, the casing comprising at least one side wall and an end wall defining a closed end;

a discharge electrode mounted in the casing, the discharge electrode being bonded to the end wall;

a sealing compound surrounding the discharge electrode and extending within the casing; and a pair of stabilizing electrodes, each stabilizing electrode being located within the casing and being bonded to an inside surface of the end wall alongside the discharge electrode.

22. A compound electrode assembly for generating a plasma in a plasma chamber of a plasma discharge device, the compound electrode assembly comprising:

a casing made of a dielectric material, the casing comprising at least one side wall and an end wall defining a closed end;

a discharge electrode mounted in the casing, the discharge electrode being bonded to the end wall;

a sealing compound surrounding the discharge electrode and extending within the casing; and an electron injection electrode mounted outside of the casing and along the side wall, the electron injection electron being configured to enable injection of free electron in the plasma chamber, the electron injection electrode being mounted on the outside of the casing with an electrically conductive adhesive, a layer of conductive compound or a ceramic-based bonding compound.

* * * * *